US007325916B2

(12) United States Patent
Baker, Jr. et al.

(10) Patent No.: US 7,325,916 B2
(45) **Date of Patent: *Feb. 5, 2008**

(54) METHOD AND APPARATUS FOR MAKING SIGNS

(75) Inventors: Peter R. Baker, Jr., Hebron, CT (US); Mark E. Guckin, Middletown, CT (US); David J. Logan, Monterey, MA (US); Russell F. Croft, Tolland, CT (US)

(73) Assignee: Gerber Scientific International, Inc., South Windsor, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/638,587

(22) Filed: Aug. 11, 2003

(65) Prior Publication Data

US 2004/0032477 A1 Feb. 19, 2004

Related U.S. Application Data

(63) Continuation-in-part of application No. 10/360,418, filed on Feb. 7, 2003, now Pat. No. 6,957,030.

(60) Provisional application No. 60/354,982, filed on Feb. 8, 2002.

(51) Int. Cl.
*B41J 2/01* (2006.01)

(52) U.S. Cl. ..... 347/101; 347/105

(58) Field of Classification Search ..... 347/101, 347/102, 105; 428/195, 32.1; 399/322, 399/147, 296, 222; 156/230, 240, 277, 208, 156/289; 430/126

See application file for complete search history.

(56) References Cited

U.S. PATENT DOCUMENTS 4,374,691 A * 2/1983 Vanden Bergh ..... 156/234
4,454,179 A * 6/1984 Bennett et al. ..... 428/40.8
4,467,525 A 8/1984 Logan et al.

(Continued)

FOREIGN PATENT DOCUMENTS

JP 63130397 A * 6/1988

(Continued)

*Primary Examiner*—Stephen Meier
*Assistant Examiner*—Leonard Liang
(74) *Attorney, Agent, or Firm*—Abelman, Frayne & Schwab

(57) ABSTRACT

An apparatus for digitally generating an image includes a printer for generating a desired image either on a final substrate or a carrier sheet with the image then being transferred from the carrier sheet onto the final substrate. The generated image is "built up" on the carrier sheet or substrate to form a sign, thereby eliminating the need for the weeding process. According to one aspect of the present invention, the apparatus includes a printer that allows the digital application of adhesive onto an image, substantially placing an adhesive in register with the image, for subsequent application of the image with adhesive placed thereon. According to a further aspect of the present invention, a layer of adhesive is applied over a substrate. An image is built atop of the adhesive. A consumable sheet is then brought in contact with the substrate to remove excess adhesive, which is still disposed on the substrate, such that once the consumable sheet is separated from the substrate, the image remains on the substrate with the adhesive disposed therebetween. According to another embodiment of the present invention, liquid film or structural ink is used to generate structure for the image.

15 Claims, 7 Drawing Sheets

U.S. PATENT DOCUMENTS 4,640,727 A * 2/1987 Janssen ..... 156/240
4,759,968 A * 7/1988 Janssen ..... 428/202
4,900,597 A * 2/1990 Kurtin ..... 428/40.2
4,919,994 A * 4/1990 Incremona et al. ..... 428/141
4,999,076 A * 3/1991 Incremona et al. ..... 156/241
5,486,397 A * 1/1996 Gordon et al. ..... 428/76
5,537,135 A 7/1996 Hevenor et al.
5,800,655 A 9/1998 Tokuchi
5,871,837 A 2/1999 Adair
6,054,090 A * 4/2000 Duis et al. ..... 264/400
6,108,022 A 8/2000 Landman et al.
6,243,120 B1 6/2001 Hevenor et al.
6,322,265 B1 11/2001 Mindek et al.
6,395,120 B1 * 5/2002 Bradbury-Harris et al. . 156/230
6,540,345 B1 * 4/2003 Wagner et al. ..... 347/103
6,613,412 B1 * 9/2003 Dressler ..... 428/41.8
6,656,306 B1 12/2003 Mabbott
6,749,707 B2 6/2004 Saksa et al.
6,824,839 B1 * 11/2004 Popat et al. ..... 428/32.12

FOREIGN PATENT DOCUMENTS

WO WO 9839166 11/1998
WO WO 03/020519 3/2003
WO WO 03/020519 A1 3/2003

* cited by examiner

METHOD AND APPARATUS FOR MAKING SIGNS

The present application claims priority from and incorporates by reference U.S. Provisional Application Ser. No. 60/354,982 filed Feb. 8, 2002 and is a continuation-in-part, claiming priority from and incorporating by reference U.S. patent application Ser. No. 10/360,418.

BACKGROUND OF THE INVENTION

1. Technical Field

The present invention relates to an apparatus and method for signmaking and, more particularly, to an apparatus and method for additive signmaking.

2. Background Art

The signmaking industry was revolutionized by technology invented and implemented by Gerber Scientific, Inc. of South Windsor, Conn., a common assignee with the present invention. Several inventions relating to signmaking are described in U.S. Pat. Nos. 5,537,135 and 4,467,525, which disclose an apparatus for printing and cutting signs on sheet material. Such signmaking apparatus includes a computer for storing image data and a printer which, based on the image data, applies colorant onto a vinyl sheet material adhered to a backing sheet. Once the desired image is printed, the sheet material is then transferred to a cutter machine. The cutter cuts through the vinyl sheet material around the contour of the image, leaving the backing sheet intact. Subsequent to the cutting operation, the unwanted vinyl material is removed or weeded from the sheet material. The desired image is subsequently applied to a transfer sheet and then to the final product.

Although the above-described method and apparatus have enjoyed great success and popularity, there are several drawbacks. First, the weeding process results in a significant amount of non-recyclable waste. Additionally, the weeding process is labor intensive and time consuming. Furthermore, the weeding process can reduce the quality of the finished sign, because when the excess vinyl material is weeded, the sign image can become damaged. Additional difficulties associated with transferring the printed sheet material from the printer to the cutter include proper alignment between the printer and the cutter. Moreover, the cutter must be properly calibrated with respect to the printer.

U.S. Pat. No. 5,871,837 to Adair entitled "Method of Fixing an Image to a Rigid Substrate" discloses a method of fixing an image to a rigid substrate coated with a thermally tackifiable coating. More specifically, the patent discloses a process wherein the image is printed onto a transfer film, the image bearing surface of the transfer film is then joined in pressing contact with a thermoplastic coating which has been warmed to a softened or tacky state. Once the thermoplastic coating is cooled to a hard, durable state, the transfer film is removed, leaving the image securely affixed to the rigid substrate. However, the process disclosed in the Adair patent has limited use. The Adair method is not practical, for example, for generating a sign for a car door. More specifically, the whole car door would have to be coated with the tacky material with the image then being transferred onto the coated door. However, once the image is adhered, the image will be surrounded by additional polymer, resulting in background haze around the image. Therefore, although the Adair patent provides an alternative to conventional signmaking, the Adair method is limited and is frequently impractical.

Another shortcoming of conventional signmaking is that the signs are not sufficiently durable for many purposes.

Although automated signmaking has significantly improved the time consuming process of manual signmaking, it is still desirable to further simplify and improve the signmaking process by eliminating the waste resulting from weeding and by generating a more durable image.

SUMMARY OF THE INVENTION

According to the present invention, an apparatus and method for an Additive Signmaking™ Process includes a printer for generating a desired image either on a final substrate or a carrier sheet with the image then being transferred from the carrier sheet onto the final substrate. The generated image is "built up" on the carrier sheet or substrate to form a sign, thereby eliminating the need for the weeding process.

According to one aspect of the present invention, referred to herein as an Adhesive Split Transfer™ Process, the printer initially prints the image onto a carrier sheet. A layer of adhesive is then applied onto the carrier sheet with the image printed thereon. Subsequently, a substrate is joined with the carrier sheet such that the layer of adhesive and image are disposed therebetween. Once the carrier sheet is removed, the image remains adhered to the substrate, completing the Adhesive Split Transfer™ Process. If necessary, the image may be cured onto the substrate for improved adherence. The Adhesive Split Transfer™ Process simplifies the signmaking process by consolidating the printing, cutting and weeding operations that are required by existing methods into a single operation. One advantage of the Additive Signmaking™ Process, in general, and of the Adhesive Split Transfer™ Process, specifically, is that the weeding process is no longer necessary, thus eliminating the waste resulting therefrom, reducing potential damage to the sign, and decreasing labor costs.

According to a further aspect of the present invention, an apparatus and method for the Additive Signmaking Process includes a printer that allows the digital application of adhesive onto an image, substantially placing an adhesive in register with the image, for subsequent application of the image with adhesive placed thereon. Digital application of adhesive onto an image significantly simplifies the signmaking process. Digital application of an adhesive eliminates the need to use coated sheet material that requires subsequent weeding.

According to a further aspect of the present invention, a layer of adhesive is applied over a substrate. An image is built atop of the adhesive. A consumable sheet is then brought in contact with the substrate to remove excess adhesive, which is still disposed on the substrate, such that once the consumable sheet is separated from the substrate, the image remains on the substrate with the adhesive disposed therebetween.

According to another embodiment of the present invention, adhesive is digitally applied to be substantially in register with the image. The adhesive is ink jetted through an ink jet print head. The adhesive may include colorants.

According to another embodiment of the present invention, liquid film or structural ink is used to generate structure for the image. The liquid film is ink jetted through an ink jet print head to be substantially in register with the image. The liquid film may be clear or translucent or include colorants.

The present invention introduces the concept of Additive Signmaking™ Process, wherein an image is built on top of a substrate without the need for weeding unnecessary material. The image can be either permanently adhered to the substrate or be temporarily placed on a carrier sheet and subsequently transferred onto a final substrate. The image can be built up with use of a variety of apparatus' and/or methods including, but not limited to, use of different colorants, multiple layers of colorants, clear coating, protective coating and/or adhesive. The present invention also introduces a concept of digitally applying adhesive onto a substrate. Furthermore, the present invention introduces another concept of applying adhesive over the entire substrate, building up an image atop of adhesive, and then removing excess adhesive. Thus, the concepts introduced by the present invention result in improved quality of the final product, as well as savings in time, labor, and materials.

The foregoing and other advantages of the present invention become more apparent in light of the following detailed description of the exemplary embodiments thereof, as illustrated in the accompanying drawings.

DETAILED DESCRIPTION OF THE PREFERRED EMBODIMENT

Figure 1:
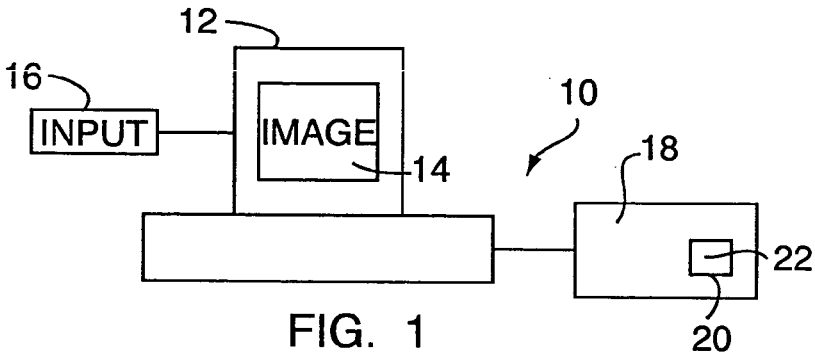
FIG. 1 is a schematic representation of a signmaking system including a computer and a printer.

Referring to FIG. 1, an Additive Signmaking™ System 10 for an Additive Signmaking™ Process, according to one aspect of the present invention, includes a programmable computer 12 for generating an image 14 based on an input data 16. The system 10 also includes a printer 18, which communicates with the computer 12. The printer 18 includes at least one developer cartridge 20 that is filled with developer 22.

Figure 2:
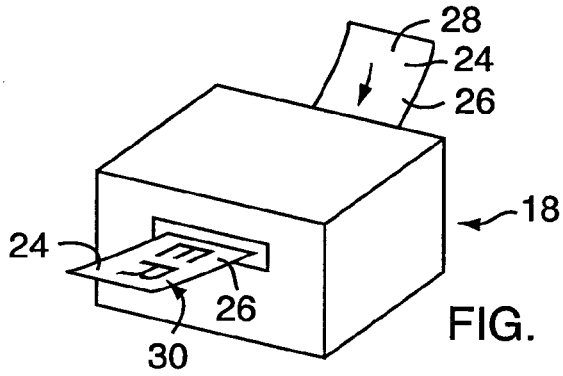
FIG. 2 is an enlarged, simplified, perspective view of the printer of FIG. 1.
Figure 4:
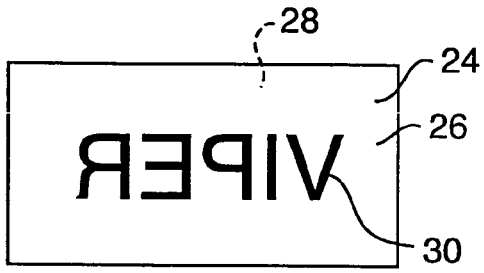
FIG. 4 is a front view of a carrier sheet with an image printed thereon in accordance with the process of FIG. 3.
Figure 5:
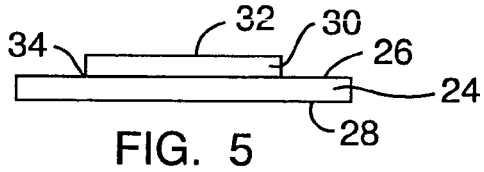
FIG. 5 is a side view of the carrier sheet and the image of FIG. 4.
Figure 6:
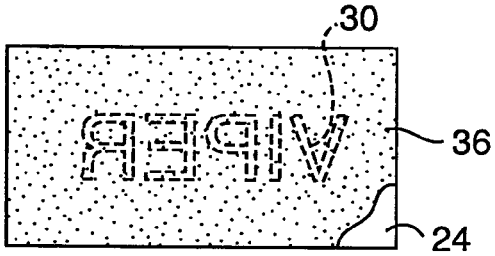
FIG. 6 is a partially broken away, front view of the carrier sheet with the image printed thereon and adhesive, in accordance with the process of FIG. 3.

Referring to FIG. 2, in an Adhesive Split Transfer™ Process, according to one aspect of the present invention, a carrier sheet 24 having a first carrier side 26 and a second carrier side 28 is placed into the printer 18. The printer 18 generates an image 30 having a first image side 32 and a second image side 34, as indicated by A2 in FIG. 3 and best seen in FIGS. 4 and 5. The image 30 is transferred onto the first side 26 of the carrier sheet 24 within the printer 18, as seen in FIGS. 2,4 and 5. In the preferred embodiment of the present invention, the image 30 is reverse printed or a mirror image is printed onto the carrier sheet 24.

Figure 3:
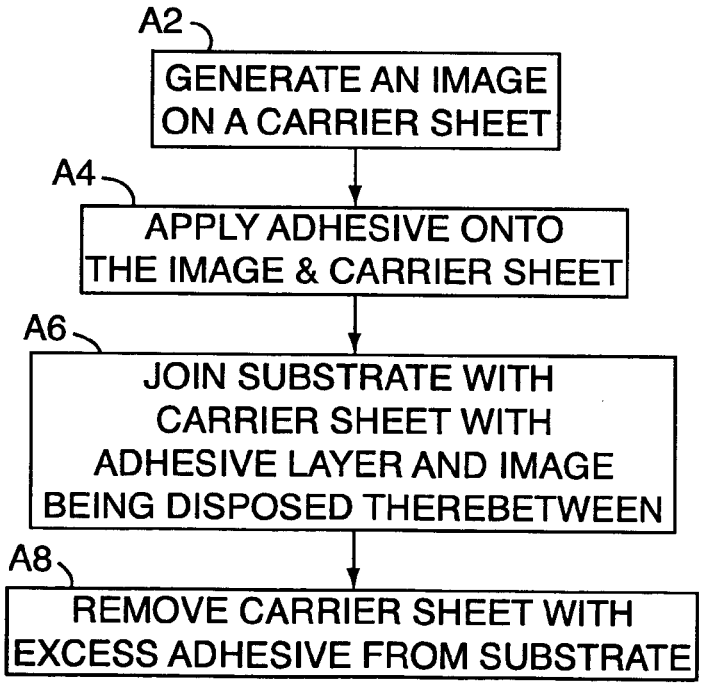
FIG. 3 is a block diagram of a process for printing a sign onto a carrier sheet for subsequent transfer to the final location using the signmaking system of FIG. 1.
Figure 7:
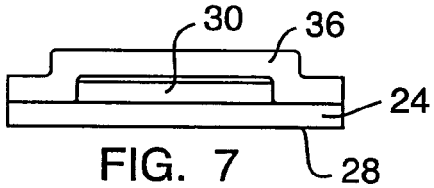
FIG. 7 is a side view of the carrier sheet, the image and the adhesive of FIG. 6.
Figure 8:
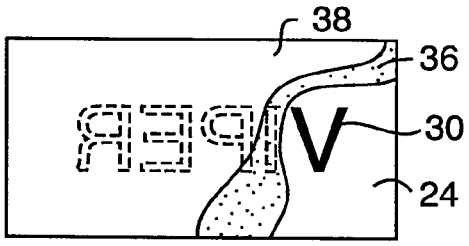
FIG. 8 is a partially broken away, front view of the carrier sheet, the image, the adhesive and substrate, in accordance with the process of FIG. 3.
Figure 9:
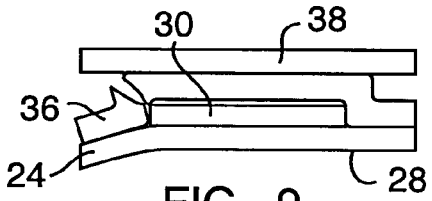
FIG. 9 is a side view of the carrier sheet, the image, the adhesive and the substrate of FIG. 8.
Figure 10:
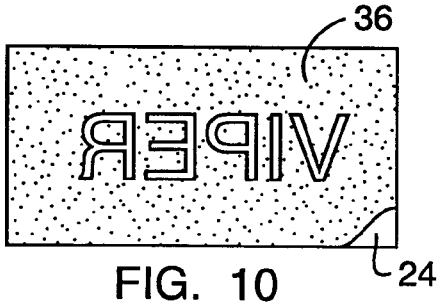
FIG. 10 is a partially broken away, front view of the carrier sheet with excess adhesive, in accordance with the process of FIG. 3.
Figure 11:
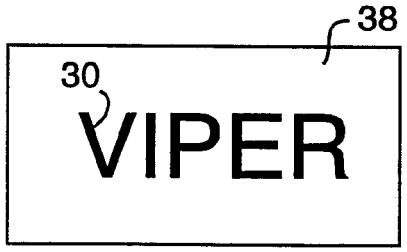
FIG. 11 is a front view of the substrate with the image adhered thereto, in accordance with the process of FIG. 3.

Referring to FIGS. 3, 5 and 7, once the image is printed onto the carrier sheet 24, an adhesive layer 36 is applied onto the first side 26 of the carrier sheet 24 and the first side 32 of the image 30, as indicated by A4 in FIG. 3. A substrate 38 is subsequently joined with the carrier sheet 24 such that the adhesive layer 36 and the image 30 are sandwiched therebetween, as indicated by A6 in FIG. 3 and shown in FIGS. 8 and 9. The substrate 38 and the carrier sheet 24 with the image 30 and adhesive 36 disposed therebetween can be pressed together for the film image 30 to properly adhere to the substrate 38. Then, the carrier sheet 24 is removed from the substrate 38, as indicated by A8 in FIG. 3 and shown in FIG. 9. The adhesive 36 that was in direct contact with the carrier sheet 24 adheres to the carrier sheet and is removed from the substrate 38, as shown in FIG. 10. With the removal of the carrier sheet 24 and excess adhesive 36 from the substrate 38, the film image 30 remains properly adhered to the substrate 38, completing the Adhesive Split Transfer process, as shown in FIG. 11. Optionally, the substrate 38 and image 30 may be additionally cured for improved adherence of the film image onto the substrate. Various curing processes can be used, including but not limited to, ultraviolet light treatment, infrared heating, RF heating and/or conventional heating.

The adhesive 36 can be any type of adhesive, as long as the adhesive has preference for the carrier sheet 24 over the substrate 38. Several different techniques can be used to apply the adhesive. One approach is to use liquid adhesives applied with a wire wrapped drawdown bar. One type of the wire wrapped drawdown bar is manufactured by Paul N. Gardner, Inc. of Pompano Beach, Fla. To obtain the appropriate coverage with the adhesive, the adhesives can be thinned to reduce the surface tension of the adhesive. Examples of such liquid adhesives are Covinax 386™ manufactured by Franklin International, Inc. of Columbus, Ohio and ScotchGrip 4224™ manufactured by 3M Corporation of St. Paul, Minn. In the preferred embodiment, the liquid adhesives were thinned with deionized water and dish soap according to the following composition: 50 ml of adhesive, 50 ml of water, and 5 ml of Joy™ dish soap. Joy™ dish soap is fabricated by Proctor & Gamble of Cincinnati, Ohio. However, numerous other liquid adhesives can be used, as long as the adhesive has preference for the carrier sheet.

Other types of adhesive that can be used are pressure sensitive adhesive films. These films are from a class known as adhesive transfer films, that include adhesive only, rather than adhesive and some other supporting film. The most commonly used adhesive films are manufactured by Xyron, Inc. of Scottsdale, Ariz. and are applied with the Xyron 850™ laminator, also manufactured by Xyron, Inc.

In the Adhesive Split Transfer Process, there are four (4) important bonds:

1. The bond between the image and the carrier sheet ("Image/Carrier");
2. The bond between the image and the adhesive ("Image/Adhesive");
3. The bond between the adhesive and the carrier sheet ("Adhesive/Carrier"); and The bond between the adhesive and the substrate ("Adhesive/Substrate").

The Adhesive Split Transfer Process will occur when the following set of relationships between the bond strengths exists:

1. The Image/Adhesive bond is stronger than the Image/Carrier bond;
2. The Adhesive/Substrate bond is stronger than the Image/Carrier bond; and
3. The Adhesive/Carrier bond is stronger than the Adhesive/Substrate bond.

Any combination of adhesive, carrier, and substrate that satisfies all three (3) of these relationships may be used for the Adhesive Split Transfer Process. The toner used to generate the image must also satisfy the above-identified relationships.

Therefore, the substrate can be fabricated from any material that allows the substrate, in the non-image area, to release adhesive to the carrier sheet and, in the image area, allows adhesive to bond the film to the substrate. The carrier sheet can be fabricated from any material that will not permanently bond to the image and is preferred over various substrates by the adhesive in the non-image area. In the preferred embodiment, Gerber 220™ vinyl and Gerber 225™ vinyl were used as the carrier sheet. Gerber 220™ vinyl and Gerber 225™ vinyl are products of Gerber Scientific, Inc. of South Windsor, Conn.

The developer can be any type of toner used in standard printers. However, in one embodiment of the present invention, the developer is either a powder paint or a dual component developer comprising ferrite carrier beads and powder paint or powder toner, as discussed in greater detail below. In the preferred embodiment, the dual component developer comprises 80-99% (eighty to ninety nine percent) ferrite carrier beads and 1-20% (one to twenty percent) powder paint or powder toner. However, in the most preferred embodiment, the developer comprises 90-95% ferrite carrier beads and 5-10% powder paint or powder toner. Use of the toner that includes powder paint or powder toner results in the generation of a durable film image. Powder Paint comprises resin and pigment is selected to be outdoor durable and UV stable.

The Additive Signmaking™ Process, in general, and the Adhesive Split Transfer™ Process, in particular, of the present invention simplifies the signmaking process by consolidating the printing, cutting and weeding operations required by conventional methods into a single operation. One advantage of the present invention is that the weeding process is no longer necessary, thus, eliminating the waste resulting therefrom, potential damage to the sign during the weeding process, and labor costs therefor. Another advantage is that when powder paint or powder toner is used, the image generated is durable, with the powder paint generated image, the image could withstand outside elements for prolonged period of time. A further advantage of the Additive Signmaking Process and of the Adhesive Split Transfer Process is that there are no limitations on where the signs can be applied. For example, these processes overcome the drawbacks of the U.S. Pat. No. 5,871,837, as discussed in the Background of the Invention section of the present invention.

Figure 12:
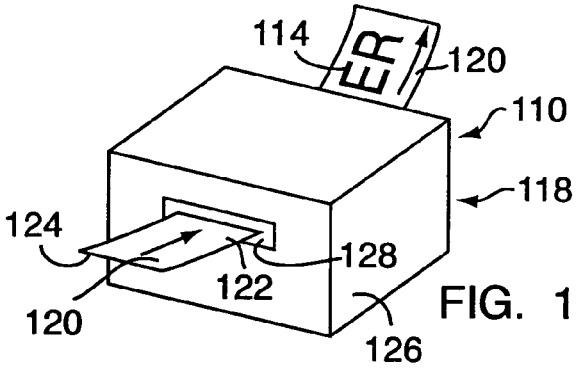
FIG. 12 is a schematic representation of a printer for an Additive Signmaking™ Process, according to another embodiment of the present invention.

Referring to FIG. 12, according to another aspect of the present invention, an Additive Signmaking™ System 110 for generating a film image 114 includes a printer 118. The film image 114 is essentially "built up" onto a substrate 120, according to the present invention. The substrate 120 has a first substrate side 122 and a second substrate side 124. The printer 118 includes a housing 126 with an input opening 128 for intaking the substrate 120 and an output opening 130 (not shown in FIG. 12) formed therein for allowing egress of the substrate 120.

This process results in "building up" of the final film image comprising multiple layers. The types of layers and order of application of the layers could vary depending on particular requirements of the final film image product. The thickness of each layer can also vary from product to product.

According to a further aspect of the present invention, the adhesive is digitally applied to either the first surface of the carrier sheet or the first image side of the film image. Adhesive is applied to areas where the film image has been or will be created. Digital application of the adhesive may be achieved through several techniques including electrophotography of a heat and/or pressure activated powdered adhesive, ink jetting of a liquid adhesive, or thermal transfer of a dry film adhesive. The digitally applied adhesives may be heat sensitive, pressure sensitive, or UV sensitive. One such type is Hot Melt powder adhesive manufactured by Union, Inc., Ridgefield, N.J. A protective film can be applied to cover the adhesive and is removed just prior to the application of the film image to the final substrate. Application of the protective film is needed when the adhesive is disposed atop of the image. In the situations when the image is disposed atop of the adhesive, the adhesive and the film image may then be lifted from the carrier sheet with transfer tape and applied to the final substrate, as is typical in traditional signmaking.

According to an additional aspect of the present invention, as discussed in greater detail below, the adhesive may contain colorant and has a dual purpose of an adhesive and a colorant. The colorant can be either pigment or dye.

Additionally, as will be discussed in greater detail below, although some systems include means for digital application of adhesive, in accordance with the teachings of the present invention, some systems may include internal or external means for applying adhesive, wherein the adhesive means may be adapted to apply adhesive either digitally to be in register with the image or globally over the entire substrate.

Referring to FIGS. 13-17, in accordance with another embodiment of the present invention, the Additive Signmaking™ Process can be implemented by building up an image 729, 829, 929 on a carrier sheet 724, 824, 924 with an adhesive layer 730, 830, 930 disposed therebetween such that the adhesive layer has been either pre-applied to the carrier sheet or applied uniformly onto the carrier sheet and excess adhesive 731, 831, 931 is subsequently removed from the carrier sheet. Thus, an adhesive layer 730, 830, 930 is initially applied onto a carrier or release sheet 724, 824, 924. A colorant 728, 828, 928 is subsequently applied onto the adhesive layer 730, 830, 930 to build an image 729, 829, 929 on top of the adhesive layer. The image adheres to the carrier sheet by means of the adhesive layer, now sandwiched therebetween. The portions of the carrier sheet without the image still have exposed adhesive portion or excess adhesive 731, 831, 931. A consumable sheet 839, 939 is then brought into contact with the carrier sheet and into direct contact with the excess adhesive 731, 831, 931 and with the image. The excess adhesive adheres to the consumable sheet 839, 939. When the consumable sheet is removed, the adhesive splits along the borders or the perimeter of the image, removing the unwanted portions of excess adhesive and leaving the previously printed image backed by the remaining adhesive on the carrier sheet.

Figure 13:
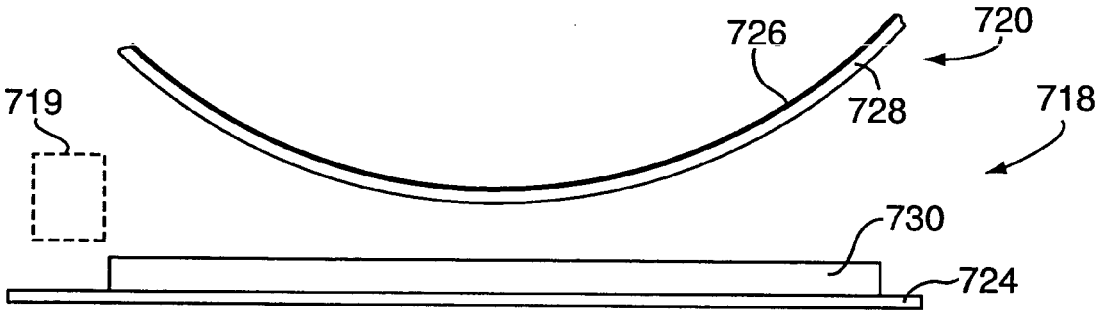
FIG. 13 is a schematic representation of a side view of a carrier sheet with an adhesive layer to be engaged by an ink foil.
Figure 14:
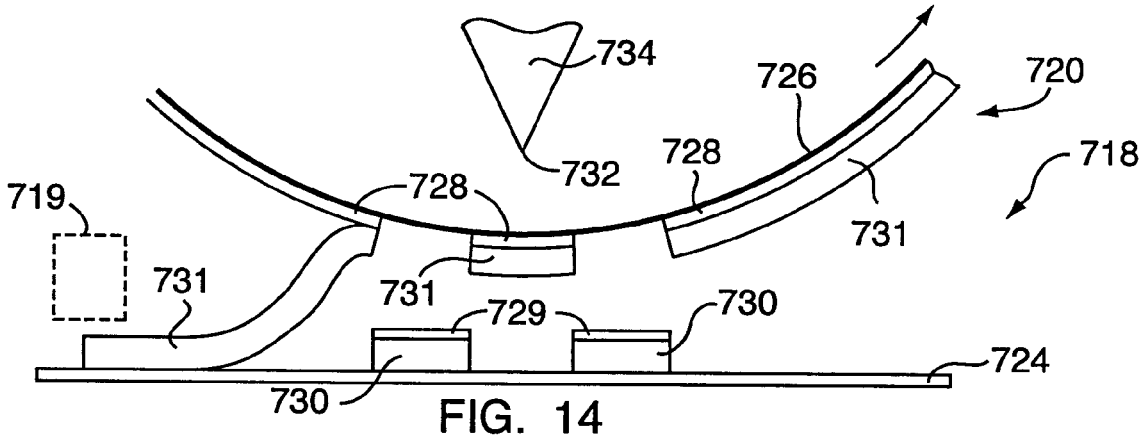
FIG. 14 is a schematic representation of the side view of the carrier sheet after engagement with the ink foil of FIG. 13.

Referring to FIGS. 13 and 14, in one embodiment, a thermal printer 718 is used to generate an image. In the preferred embodiment, a MAXX™ system has been used. The MAXX™ system is a signmaking apparatus manufactured by Gerber Scientific Products, Inc. of South Windsor, Conn., an assignee of the present invention. The MAXX™ system is described in U.S. Pat. Nos. 6,243,120 and 6,322,265, with their disclosures being incorporated herein by reference. However, other thermal printers can be used. As is well known in the art, a thermal printer or signmaking apparatus includes a thermal printhead that comes into contact with an ink foil to generate an image on a substrate.

Referring to FIG. 13, in a thermal system 718, an ink foil 720 comes into contact with an adhesive layer 730 disposed on a carrier sheet 724. The ink foil 720 comprises a foil 726 with resin 728 disposed thereon. As is known in the art, resin or colorant 728 is subsequently separated from the foil to generate an image 729. In the preferred embodiment of the present invention, the release or carrier sheet 724 is coated with the adhesive layer 730 and is placed into the thermal printer with the adhesive layer 730 facing the ink foil 720. In this embodiment, the ink foil 720 also serves as a consumable sheet.

In operation, referring to FIG. 14, as the thermal system 718 selectively energizes printing elements 732 of a thermal printhead 734 that come into contact with the carrier sheet 724 with the foil 720 and the adhesive layer 730 disposed therebetween to generate an image, the resin 728 that is disposed substantially below the energized printing elements 732 is transferred from the foil 720 onto the carrier sheet 724, atop of the adhesive layer 730, thereby printing the image 729 onto the adhesive layer 730 of the carrier sheet 724. Excess adhesive 731 or portions of the adhesive layer 730 that do not have resin 728 disposed atop thereof, adhere to the resin remaining on the foil 720 and are, thereby, removed from the carrier sheet 724 and rolled onto the takeup roll (not shown) with the used foil. Thus, when the printing of the image 729 is completed, the carrier sheet 724 is free of exposed or excess adhesive 731 except in the area of the image, and includes the image disposed thereon with the adhesive layer sandwiched between the carrier sheet and the image. Subsequently, the image can be transferred with transfer tape onto its final location. Optionally, the carrier sheet with the adhesive layer and the image can be cured.

The adhesive layer 730 can be either pre-applied onto the carrier sheet or applied internally within the system 718 by an adhesive application means 719.

The release or carrier sheet 724, adhesive 730, and foil 720 can be a variety of products. However, the carrier sheet must allow the release of adhesive with the adhesive having a preference for the foil over the carrier or substrate and with resin having a preference for the adhesive over the foil when the foil is in contact with the energized printing element. In the preferred embodiment, polymer coated paper, such as the backside of the carrier used with Gerber Quantum 4000™ vinyl, a product of Gerber Scientific, Inc. of South Windsor, Conn., was used. One type of adhesive is Covinax 386™, manufactured by Franklin International, Inc. of Columbus, Ohio. Any type of ink foil can be used.

Figure 15:
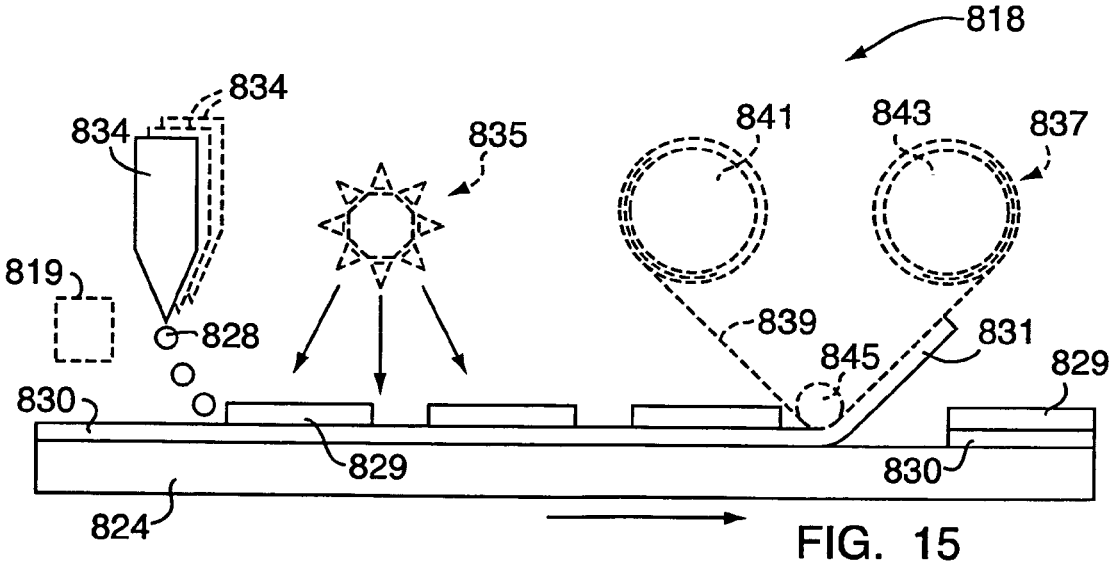
FIG. 15 is a schematic representation of an apparatus for generating signs.

Referring to FIG. 15, in another embodiment of the present invention, an ink jet system 818 is used to apply ink or colorant 828 to form an image 829 over the pressure sensitive adhesive film 830. The ink jet system 818 is adapted to either receive a carrier sheet 824 with adhesive 830 applied or to apply adhesive 830 to the carrier sheet 824 by adhesive application means 819. The ink jet system 818 also includes at least one ink jet print head 834 to dispense ink 828 to form the image 829 atop the carrier sheet with the adhesive layer 830 disposed therebetween. The ink jet system 818 may further include a curing station 835 for curing ink onto the adhesive layer and onto the carrier sheet 824. Alternatively, the image 829 can be cured outside of the system 818. The curing station 835 can provide any type of curing, including UV cure lamp, infrared, laser, thermal and/or others. The ink jet system 818 also includes means for removing excess adhesive 837. In the preferred embodiment of the present invention, the means for removing excess adhesive 837 includes a consumable sheet 839 that contacts the carrier sheet with the image and excess adhesive thereon such that upon separation of the consumable sheet and the carrier sheet, the excess adhesive 831 remains on the consumable sheet 839 and the carrier sheet 824 or substrate has the image disposed thereon with the adhesive 830 disposed therebetween.

In one embodiment, the means for removing excess adhesive 837 is a consumable sheet, such as foil, rolled on a supply roll 841 with the foil being dispensed from the supply roll and taken up by a take up roll 843. A pressure roller 845 is disposed between the supply roll and the take up roll. The pressure roller acts on the back side of the foil to apply a substantially uniform pressure which promotes the desired adhesive bonding between the foil 839 and the exposed, unwanted adhesive 831. The take up roller acts to peel and store the foil and the excess adhesive. After the foil and unwanted adhesive have been removed, the release or carrier sheet 824 is free of the excess adhesive except where the adhesive resides underneath the printed image.

In an alternate embodiment, the means for removing excess adhesive 837 is disposed outside the system 818.

The non-contact nature of ink jet printing is desirable because it simplifies the problems associated with handling the adhesive coated carrier sheet. UV cure inks are desirable because they are 100% solids (during the UV cure process, 100% of the liquid ink is converted to solid polymer) and will form a film over the adhesive when printed. Traditional water-based or solvent-based inks will not form a solid film upon drying and, therefore, may not provide sufficient structure for blocking of the adhesive. Phase change inks where the colorant is disbursed in wax are also 100% solid and will form a film over the adhesive. For sign making applications, the UV cure inks are generally preferred over phase change inks because they provide a more durable image.

According to another aspect of the present invention, the image can be generated when liquid film or structural ink is used. The liquid film is used to generate a sturdy, durable and transferrable image. The liquid film or structural ink, as referred to in the present application, is an ink jettable, liquid polymer that can be cured into a film with many of the same properties found in the cast and calendared vinyl films that are well known in the sign making and specialty graphics industry.

The liquid film, in accordance with the present invention, provides the structure for the image and subsequently, the sign; may provide a base upon which images are generated; and/or may be used to generate the image itself, as will be discussed in greater detail below. The liquid film may include a combination of the following properties and/or characteristics: reflective, translucent, metallic, photoluminescant, glossy, matte and/or frosted.

One type of ink that was used to generate a sign from liquid film was from Sericol Imaging, operating through its parent company, Sericol International, based in Broadstairs, UK. The sign was generated by printing six (6) layers of Sericol Uvijet ink with a Xaar XJ126 manufactured by Xaar PLC of Cambridge, UK, drop on demand printhead at 360 DPI. The ink was cured with an Integration Technology VZero 085 UV lamp. The images were printed onto Xyron Low Tack Permanent adhesive (P/NAT202-50). The Xyron cartridge that contained the adhesive also contained the adhesive removal film that was used. The total thickness of one sign generated was approximately 3.5 mils. The adhesive was approximately 1-2 mils thick and the film that was printed onto the adhesive was 1-2 mils thick. However, other materials and equipment can be used and thicker or thinner adhesives may be used and thicker or thinner films may be generated.

Referring back to FIG. 15 and according to a further embodiment of the present invention, the adhesive 830 includes white colorant therein with at least one ink jet print head 834 dispensing structural ink, which may be process color, spot color, or combination thereof. The white adhesive 830 provides a background for the image 829.

According to a further embodiment of the present invention, the adhesive transfer film 830 includes at least one spot color for the final image 829. The at least one print head 834, in this embodiment, dispenses clear structural ink to provide structure for the resulting sign, as seen in FIG. 15.

Figure 16:
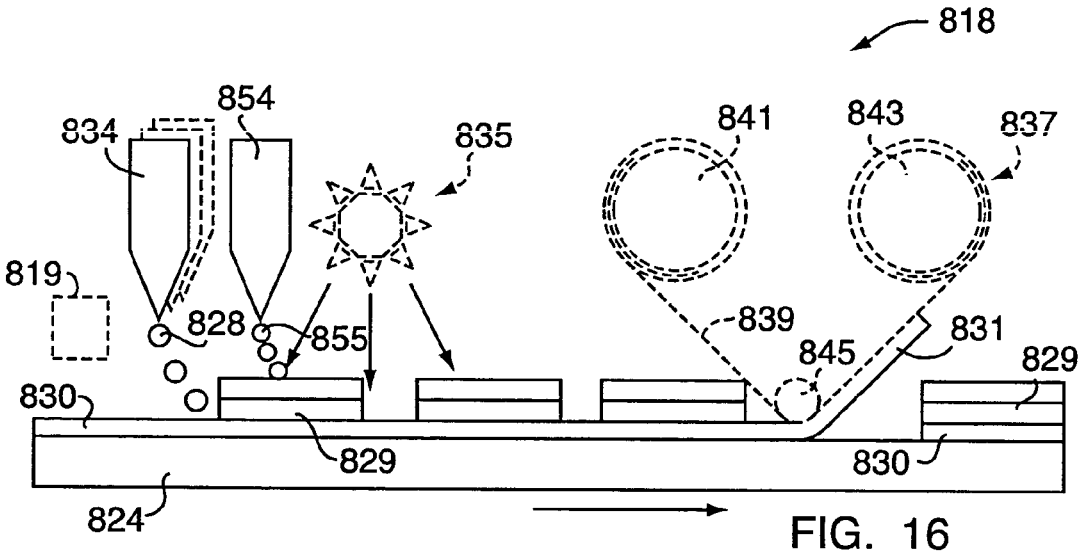
FIG. 16 is a schematic representation of another embodiment of an apparatus for generating signs.

Referring FIG. 16 and according to yet another embodiment of the present invention, the adhesive transfer film 830 is white. The at least one ink jet print head 834 includes colorant(s) which may be spot colors, process colors or both. At least one additional ink jet print head 854 dispenses clear structural ink 855 atop of the ink colors to provide a protective layer and structure for the image 829.

Still referring to FIG. 16, in accordance with a further embodiment of the present invention, an ink jet system 818 includes at least one ink jet printhead 834 dispensing at least one colorant 828 onto an adhesive layer 830 disposed atop of a carrier sheet 824. The at least one colorant 828 defines an image 829 that is reversed printed. The system 818 further includes an ink jet printhead 854 for dispensing liquid film 855 atop of the image 829. In the preferred embodiment of the present invention, the liquid film is white to provide background for the image 829. This embodiment is particularly suited for signs that are placed on the inside of a glass to be seen outside, such as a store window.

Figure 17:
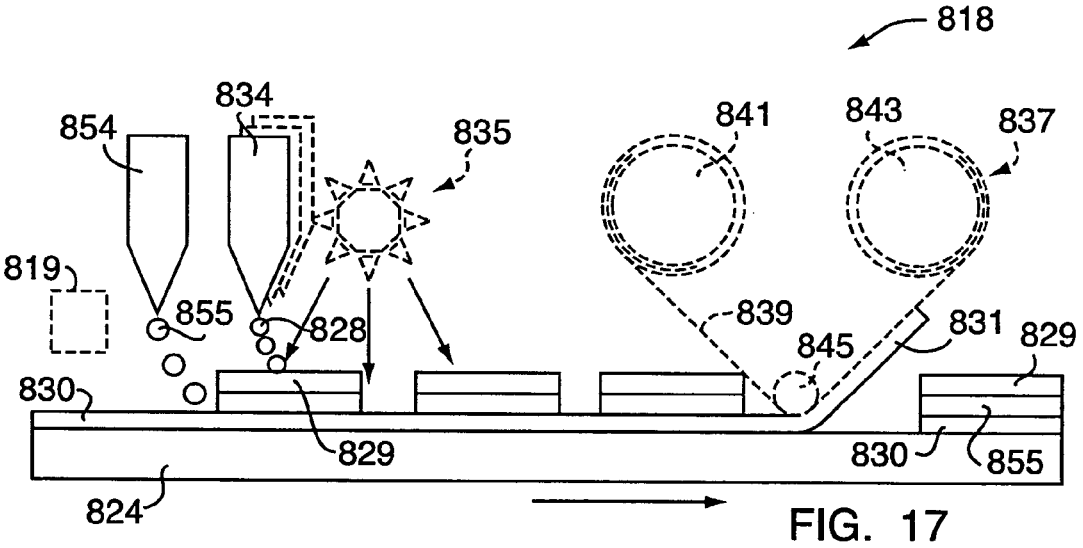
FIG. 17 is a schematic representation of another embodiment of an apparatus for generating signs.

Referring to FIG. 17, according to a further embodiment of the present invention, the adhesive transfer film 830 is disposed atop a carrier sheet 824. The ink jet print head 854 dispenses white structural ink 855 onto the adhesive layer 830. At least one ink jet print head 834 dispenses ink jet colors 828, which may be spot process or both, atop of the structural ink layer 855 to form a sign.

For embodiments depicted in FIGS. 13-17, the adhesive application means 719, 819 is optional. The carrier sheet 724, 824 can have adhesive 730, 830 either pre-applied prior to entering the system 718, 818 or the adhesive application means 719, 819 may be incorporated into system 718, 818 to apply adhesive globally to the carrier sheet 724, 824. Furthermore, the curing system 835 can be either included in the system 818 or disposed outside of the system. Similarly, the means for removing excess adhesive 837 may be either internal to the system 818 or external.

Figure 18:
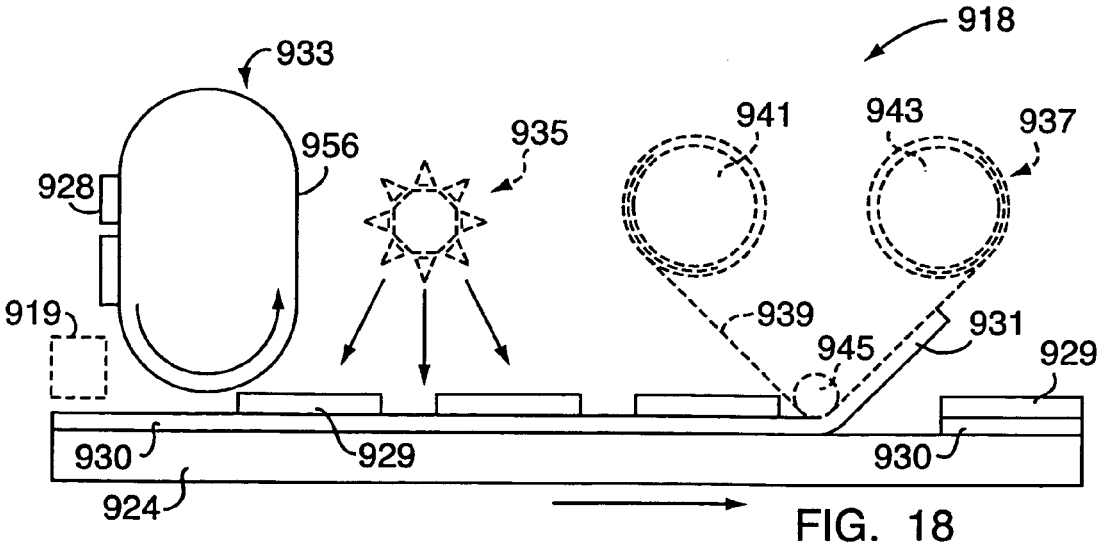
FIG. 18 is a schematic representation of another embodiment of an apparatus for generating signs.

Referring to FIG. 18, in a further embodiment of the present invention, an electrophotographic system 918 includes means for electophotographically generating an image 928, means for fusing 935, and means for removing excess adhesive 937. The system 918 may or may not include means for applying adhesive 919, as discussed above. The means for electophotographically generating an image 933 can have various configurations, some of which are described above and shown in FIGS. 13-18 of the parent application, U.S. patent application Ser. No. 10/360,418. Thus, the means for electrophotographically generating an image 928 builds a single or multiple color powder image on a photoconductor roller or belt or a final transfer roller or belt 956. The image is then electrostatically transferred onto the adhesive layer 930 disposed atop of the carrier or release sheet 924. The imaged powder toner or powder paint 928 is subsequently fused into a film image 929 disposed atop of the carrier sheet with the means for fusing 935. The carrier sheet 924 with the fused image 929 and excess adhesive 931 still disposed thereon is brought into contact with the consumable sheet 939 of the means for removing excess adhesive 937. In the embodiment shown, the means for removing excess adhesive 937 is substantially analogous to the means 837 shown in FIG. 15 and described above.

The powder paint or powder toner materials 928 used for imaging in the electrophotographic systems described in the above-referenced parent application, form a solid film that can be either used as a sign on the carrier sheet or subsequently transferred onto a final substrate.

For the embodiments describing removal of excess adhesive, it is not necessary to remove the consumable sheet 839, 939 in the printer. Rather, it may be desirable to leave the consumable sheet atop the carrier sheet and the excess adhesive as a protective layer to be removed at the time of application to the final substrate.

For multi-color printing wherein multiple foils or colorants are used sequentially, in the preferred embodiment, it may be preferable to initially print over the entire image area with clear-abrasion guard, white ink or similar transparent ink to remove an appropriate amount of adhesive from the carrier sheet while leaving adhesive on the entire image area. Then, various colors or half-tone colors can be printed, as necessary. For example, in some instances there will be a physical limit on the smallest amount of adhesive that can be reliably removed by the above-described technique. In those situations, as a first imaging step, a backing material can be applied initially upon which subsequent colors will be printed. Process color half-tone printing techniques, which are employed to generate picture images provide the clearest example of this situation. The small dots of Cyan, Magenta, Yellow, and Black color that are used to generate half-tone images are generally too small to have the adhesive split around them. To circumvent this problem, a backing layer of, usually but not necessarily, white, translucent or clear, is applied over the entire image area. By printing a clear coating over the entire image area, the adhesive is only required to split along the perimeter of the image area rather than along the perimeter of each individual dot used to generate the half-tone image. This technique can also be used to simplify more basic multi-color printing when multiple colors are serially applied to generate a multi-color image, such as in thermal transfer printing, ink jet printing or electrophotographic printing. If a backing layer is first printed over all areas that are to receive any color, the unwanted adhesive may be removed at the beginning of the sign making process. All subsequent printing steps occur in the absence of any exposed adhesive, which simplifies material handling in the printer.

Figure 19:
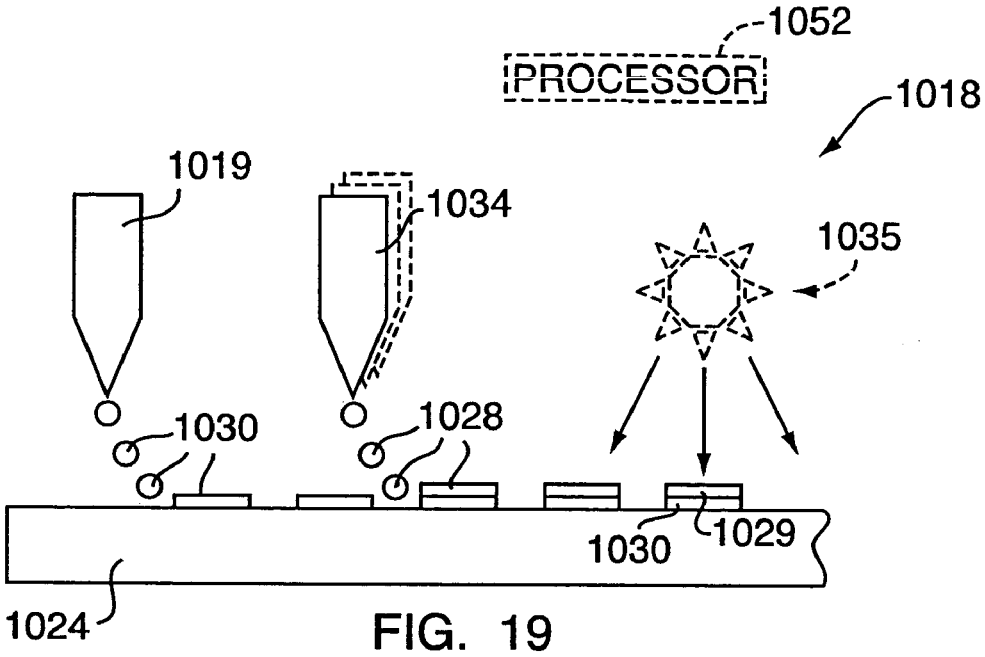
FIG. 19 is a schematic representation of another embodiment of an apparatus for generating signs

Referring to FIG. 19, according to another embodiment of the present invention, an ink jet system 1018 includes an adhesive application means 1019, at least one ink jet print head 1034, and a curing station 1035. The adhesive application means 1019, in the preferred embodiment of the present invention, is an ink jet adhesive head for selectively dispensing adhesive 1030 onto a carrier sheet 1024. The ink jet system 1018 may also include an internal processor 1052 or be controlled remotely through an external computer 12, as shown in FIG. 1. The ink jet adhesive head 1019 digitally applies adhesive 1030 onto the carrier sheet 1024 to be substantially in register with the image. Once the adhesive is applied, the ink jet head 1034 applies ink or colorant 1028 onto the adhesive 1030 to form an image 1029. The curing station 1035 provides any type of curing, including UV curing lamp, infrared laser, thermal and/or others. In the preferred embodiment, as discussed above, the ink jet system 1018 uses UV cured inks. Although other types of adhesives can be used, the preferred adhesive as discussed above, is adhesive number 13-82-4, fabricated by C Tech, LLC of New Hartford, Conn.

The advantage of this embodiment of the present invention is that the system 1018 generates a sign with the least number of steps and eliminates the need for both weeding and removing excess adhesive. Thus, the system 1018 of the present invention generates a sign with appropriate amount of adhesive and colorant. As discussed above, adhesive may also serve as colorant. For example, the adhesive may include dye or pigment to provide color for the sign. Additionally, adhesive can be either white to provide background for process colors or transparent.

According to one aspect of the present invention, the ink 1028 is structural ink that provides structure to the image 1029 and the resulting sign, as disclosed above. More specifically, the at least one ink jet head 1034 dispenses liquid film or structural ink. Such structural liquid, once dispensed and cured, forms a structural film, sufficiently sturdy and durable to be handled and transferred as a sign. The structural liquid can be process color, spot color, or both. The structural ink can also be generally clear or white and used either as a background for color or protective film.

Thus, referring to FIG. 19, the ink jet head 1034 can dispense a standard ink or structural ink, which can be either process color, spot color or both.

Figure 20:
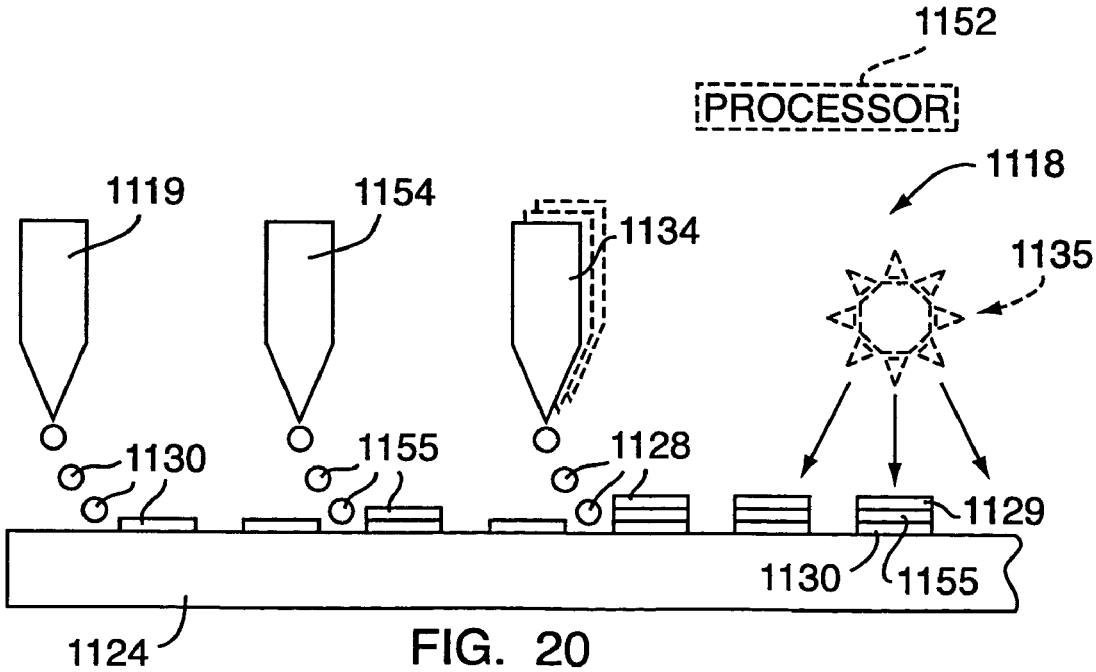
FIG. 20 is a schematic representation of another embodiment of an apparatus for generating signs

Referring to FIG. 20, in another embodiment of the present invention, an adhesive 1130 is dispensed from an ink jet adhesive head 1119 onto a carrier sheet 1124. An ink jet print head 1154 dispenses ink jet printed base liquid film 1155 to form a clear or white layer atop of the adhesive layer 1130 and to provide structure to the resulting sign. Subsequently, at least one ink jet print head 1134 dispenses at least one ink or colorant 1128 onto the liquid film layer 1139 to provide color to the resultant sign. The printed color may be either process colors, spot colors, or both. The layers 1130, 1139 and 1129 are subsequently cured to form a durable sign.

Figure 21:
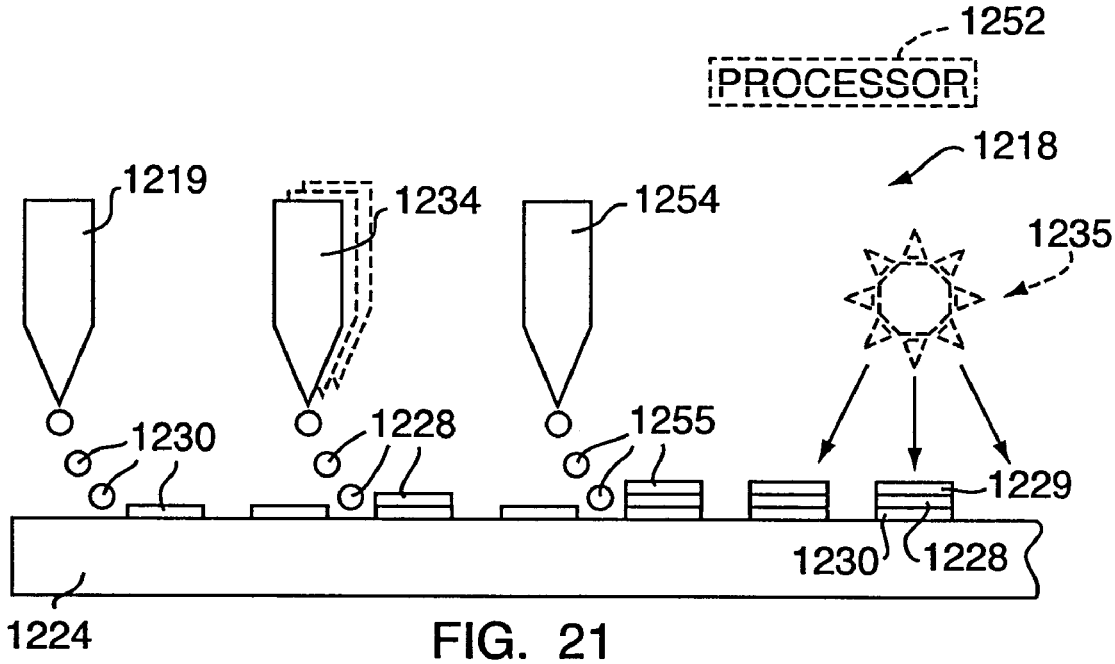
FIG. 21 is a schematic representation of another embodiment of an apparatus for generating signs.

Referring to FIG. 21, in a further embodiment of the present invention, an ink jet printer 1218 includes an ink jet adhesive head 1219 for dispensing ink jet printed adhesive 1230 to form an adhesive layer on a carrier sheet 1224. The ink jet printed adhesive in this embodiment of the present invention includes white colorant and is, therefore, white. The ink jet printing system 1218 further includes at least one ink jet print head 1234 for dispensing at least one colorant. The colorant(s) may be process colors, spot colors, or both. The system 1218 further includes an ink jet head 1254 for dispensing liquid film 1255. The liquid film is dispensed atop of the colorant layer 1228 and is clear to provide a protective layer to the resulting sign. A curing mechanism 1235 cures the layers 1230, 1229,1239 for rendering a strong and durable sign.

Figure 22:
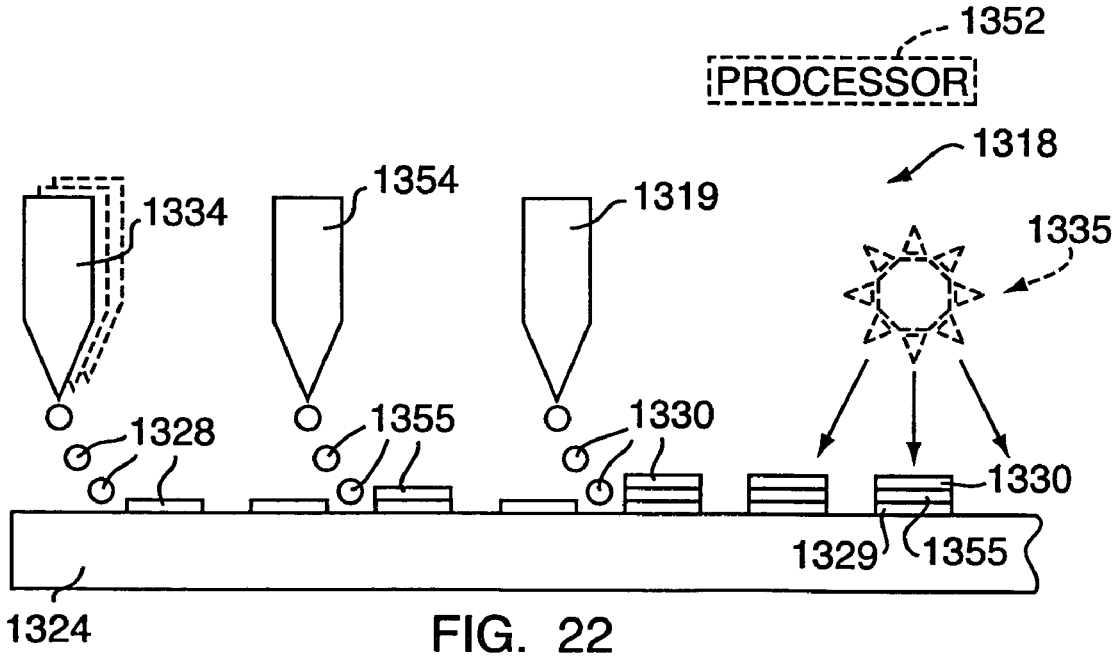
FIG. 22 is a schematic representation of another embodiment of an apparatus for generating signs.

Referring to FIG. 22, according to a further embodiment of the present invention, an ink jet system 1318 includes at least one ink jet print head 1334 that dispenses at least one ink jet printed colors 1328, which may be process colors, spot colors, or both to form an image layer 1329 on a carrier sheet 1324. The ink jet system 1318 further includes an ink jet liquid film head 1354 that dispenses liquid film 1355 to be placed atop of image layer 1329. In this embodiment of the present invention, the liquid film is either clear or white and provides structure to the resultant sign. The ink jet system 1318 further includes an ink jet adhesive head 1319 that digitally dispenses ink jet printed adhesive 1330 atop of the image layer 1329 and the protective layer 1355. The ink jet printed color layer 1329, the protective layer 1355, and the adhesive layer 1330 are then cured by the curing means 1335 to form a sign.

Figure 23:
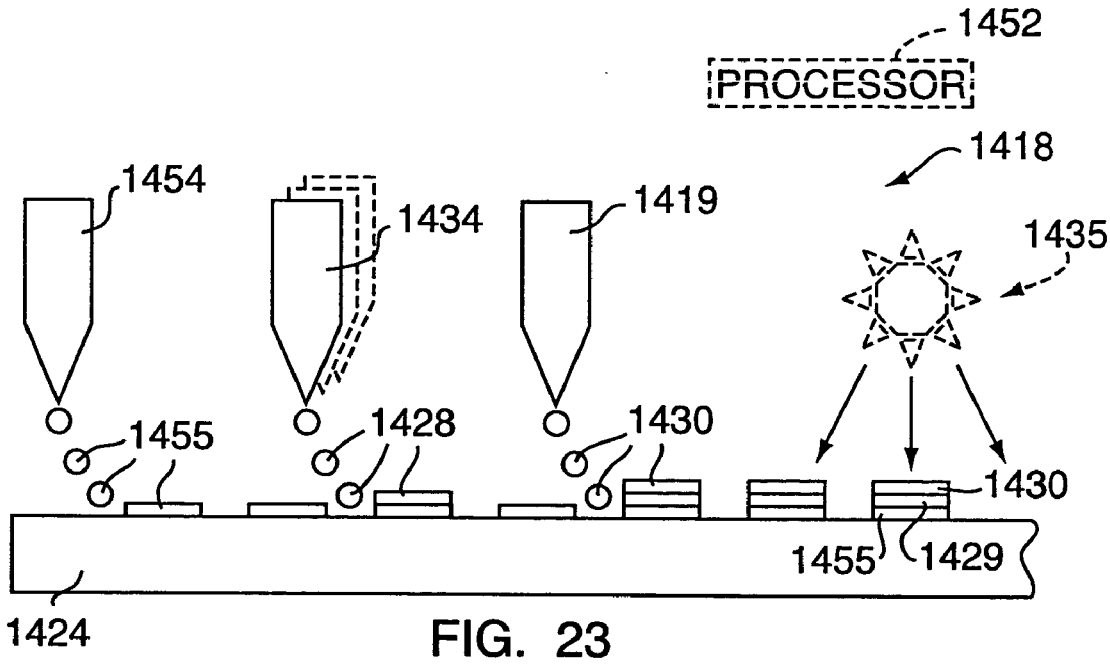
FIG. 23 is a schematic representation of another embodiment of an apparatus for generating signs.

Referring to FIG. 23, according to another embodiment of the present invention, an ink jet system 1418 includes an ink jet liquid film head 1454, dispensing substantially clear liquid film 1455 onto a carrier sheet 1424. The ink jet system 1418 also includes at least one ink jet head 1434 including at least one colorant 1428, which may be process colors, spot color or combination thereof to be digitally placed atop of the liquid film layer 1455. The ink jet system 1418 further includes an adhesive ink jet head 1419 dispensing adhesive 1430 to be placed substantially in register with the liquid film layer 1455 and at least one colorant layer 1428. The layers 1455, 1429 and 1430 are subsequently cured by the curing means 1435. This embodiment of the present invention may need an adhesive protection layer be placed atop of the adhesive layer 1430 for subsequent transfer onto a final substrate.

Figure 24:
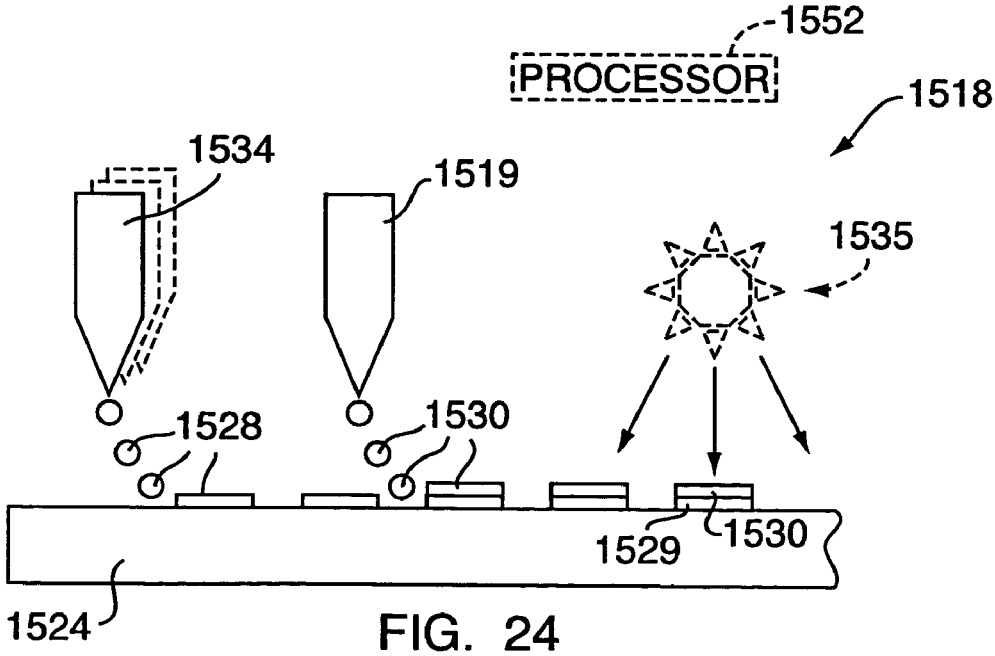
FIG. 24 is a schematic representation of another embodiment of an apparatus for generating signs.

Referring to FIG. 24, in accordance with a further embodiment of the present invention, an ink jet system 1518 includes at least one ink jet head 1534 to dispense at least one structural ink or liquid film 1528 that includes colorants, which may be either process colors, spot colors or combination thereof, as well as white or clear, onto a carrier sheet 1524. Thus, the layer 1528 may include colors for the final sign as well as structural ink to provide structure thereto. The ink jet system 1518 further includes an ink jet adhesive head 1519 that digitally dispenses ink jet printed adhesive 1530 atop of the image layer 1529. In this embodiment of the present invention, an adhesive protection layer may be included to protect adhesive until the sign is applied to the final substrate.

According to a further embodiment of the present invention, the image 1029, 1129, 1229, 1329, 1429, 1529 can be reversed printed with either adhesive, structural ink or conventional ink including white colorant to provide background for the image. Thus, the resulting sign can be applied to inside of glass to be seen from the outside.

The present invention introduces the concept of the Additive Signmaking Process, as opposed to other known processes of signmaking, such as weeding. The Additive Signmaking Process includes building an image or film onto a substrate. The built up film or image either can be permanently adhered to the substrate or subsequently transferred onto a final substrate. The building up of the image or film can involve either a single layer of developer or multiple layers, including, but not limited to, different colors of developers, clear coating film and/or adhesive. The Additive Signmaking Process has great advantages over the weeding signmaking process. The Additive Signmaking Process eliminates the need for weeding excess material from the sign, thus eliminating waste from the weeding and minimizing potential damage to the actual sign. Use of powder paint and powder toner in signmaking has tremendous advantages. Use of powder paint and powder toner in signmaking yields durable signs capable of being used outdoors.

Although powder paint is well known in some industries, such as automotive, use of powder paint in the signmaking industry has not been known. Similarly, although powder toner has been used in office laser printers and copiers for regular printing operations, powder toner in durable signmaking has not been used.

While the present invention has been illustrated and described with respect to a particular embodiment thereof, it should be appreciated by those of ordinary skill in the art, that various modifications to this invention may be made without departing from the spirit and scope of the present invention. For example, although the printer 118 was described as having a preferred configuration, many other configurations are within the scope of the present invention. Additionally, although the preferred embodiment describes an electrophotographic printer, other types of printers, such as thermal, ink jet, and/or laser, can be used to generate an image and/or durable film image to be used in the Additive Signmaking Process and/or Adhesive Split Transfer Process.

We claim:

1. An apparatus for generating an image comprising: means for applying at least one colorant onto a carrier coated with an adhesive layer to form the image atop of said adhesive layer; and means for removing excess adhesive from the carrier before application of the image to a substrate.

2. The apparatus according to claim 1 wherein said means for applying at least one colorant is at least one ink jet print head.

3. The apparatus according to claim 1 wherein said at least one colorant comprises liquid film.

4. The apparatus according to claim 1 wherein said adhesive includes colorant.

5. The apparatus according to claim 1 wherein said means for removing said excess adhesive is a system bringing a consumable sheet material into contact with said carrier to remove said excess adhesive upon separation of said consumable sheet with material from said carrier leaving said image disposed atop of said carrier with said adhesive layer sandwiched therebetween.

6. The apparatus according to claim 5 wherein said consumable sheet material is foil.

7. The apparatus according to claim 1 wherein said means for removing said excess adhesive comprises: a supply roll for dispensing a consumable sheet material; and a take up roll for taking up said consumable sheet material with said excess adhesive disposed thereon.

8. The apparatus according to claim 7 further comprising: a pressure roller disposed between said supply roll and said take up roll and substantially adjacent to said consumable sheet material to apply pressure thereto to promote bonding between said consumable sheet material and said excess adhesive.

9. An apparatus for generating an image, said apparatus comprising: means for feeding a sheet having adhesive thereon proximate to at least one ink jet print head for forming an image on the adhesive, said at least one ink jet print head having liquid film disposed therein to provide structure to said image; and means for removing from the sheet, excess portions of the adhesive which are not covered by the image.

10. A method for generating an image for placement on a surface comprising the steps of: providing a first sheet; before generating the image for application to the surface, providing an adhesive layer on top of the first sheet; and generating said image by forming at least one image layer on top of said adhesive layer, wherein adhesive not covered by an image layer is removed before application of the image to said surface.

11. An apparatus for generating a graphic for a sign comprising: means for feeding a first sheet coated with an adhesive layer proximate to a means for forming a graphic atop a portion of said adhesive layer and areas of excess adhesive; means for supplying a second sheet to contact the excess adhesive; and means for collecting the second sheet with substantially all excess adhesive attached thereto.

12. A method for generating a sign comprising the steps of: providing a substrate and before applying an image thereon, providing an adhesive layer on top of the substrate; forming at least one image layer on top of the adhesive layer leaving areas having excess adhesive; and removal of the excess adhesive before placement of the sign.

13. A method for generating a graphic article comprising the steps of: providing a substrate and before applying an image thereon providing an adhesive layer on top of the substrate; forming at least one image layer on top of the adhesive layer and areas having excess adhesive; and removal of the excess adhesive before placement of the graphic article.

14. Apparatus for generating a sign comprising: means for feeding a substrate coated with an adhesive layer proximate to a means for forming at least one image layer atop of a portion of said adhesive layer leaving non-image areas with exposed areas of adhesive thereon; means for supplying a second sheet to contact the exposed adhesive; and means for collecting the second sheet with substantially all exposed adhesive attached.

15. Apparatus for generating a sign comprising: means for feeding a carrier sheet coated with an adhesive layer proximate to a means for forming at least one image layer atop of a portion of said adhesive layer leaving non-image areas with exposed areas of adhesive; means for supplying a second sheet to contact the exposed adhesive; means for collecting the second sheet with substantially all exposed adhesive attached; and means for covering the image during transfer from the carrier sheet to a substrate.

* * * * *